United States Patent [19]

Sugiura

[11] 4,051,824

[45] Oct. 4, 1977

[54] INTERNAL COMBUSTION ENGINE FOR MOTOR VEHICLES

[75] Inventor: Katsuhiko Sugiura, Tama, Japan

[73] Assignee: Fuji Jukogyo Kabushiki Kaisha, Tokyo, Japan

[21] Appl. No.: 634,787

[22] Filed: Nov. 24, 1975

[30] Foreign Application Priority Data

Nov. 30, 1974 Japan ..... 49-138762

[51] Int. Cl.[2] ..... F02N 25/06

[52] U.S. Cl. ..... 123/119 A; 123/127; 261/69 R

[58] Field of Search ..... 123/119 A, 127; 261/41, 261/49, 69

[56] References Cited

U.S. PATENT DOCUMENTS

| | | | |
|---|---|---|---|
| 3,269,377 | 8/1966 | Fleming | 123/119 A |
| 3,633,553 | 1/1972 | Holzapfel | 123/119 A |
| 3,768,787 | 10/1973 | Marsee | 123/119 A |
| 3,800,766 | 4/1974 | Schubeck | 123/119 A |
| 3,809,039 | 5/1974 | Alquist | 123/119 A |
| 3,817,225 | 6/1974 | Priegel | 123/119 A |
| 3,847,125 | 11/1974 | Malherbe | 123/119 A |
| 3,872,845 | 3/1975 | Schultz | 123/119 A |
| 3,941,105 | 3/1976 | Yagi | 123/119 A |
| 3,944,634 | 3/1976 | Gerlach | 123/119 A |
| 3,971,351 | 7/1976 | McKee | 123/119 A |

*Primary Examiner*—Ronald H. Lazarus
*Assistant Examiner*—Daniel J. O'Connor
*Attorney, Agent, or Firm*—Martin A. Farber

[57] ABSTRACT

An internal combustion engine has an exhaust gas recirculation system to recirculate a portion of exhaust gases into an induction passage downstream of a throttle valve under the control of a valve device that is actuated by a vacuum in the induction passage and has a carburetor including a manifold vacuum responsive enriching system. The engine also has means detecting conditions where recirculation of exhaust gases is effected and valve means for controlling vacuum applied to a servo in the enriching system to render the enriching system in its operative condition. The enriching system may include a conventional power piston device which increases fuel flow during high power demanded conditions or a conventional air fuel mixture circuit system which supplies air fuel mixture to the induction passage downstream of the throttle valve during periods of deceleration.

6 Claims, 2 Drawing Figures

INTERNAL COMBUSTION ENGINE FOR MOTOR VEHICLES

The present invention relates to an internal combustion engine for motor vehicles and more particularly to an internal combustion engine having an exhaust gas recirculation (EGR) system.

Although it is one of the effective measures to reduce $NO_x$ concentration in exhaust gases to recirculate a portion of exhaust gases into an induction passage upstream of a venturi or into the induction passage downstream of a throttle valve, recirculating exhaust gases into the induction passage upstream of the venturi causes icing and accumulation of deposit such as carbon around or in a fuel supply port opening into the venturi and a vacuum sensing port opening into the induction passage, whereas recirculating exhaust gases into the induction passage downstream of the throttle valve results in an increase of air to fuel ratio causing the engine to run irregularly.

One object of the present invention is to provide an internal combustion engine in which exhaust gases are recirculated into an induction passage downstream of a throttle valve and which includes means for compensating for increasing the air to fuel ratio due to the recirculation of the exhaust gases to maintain the air to fuel ratio within proper values.

Figure 1:
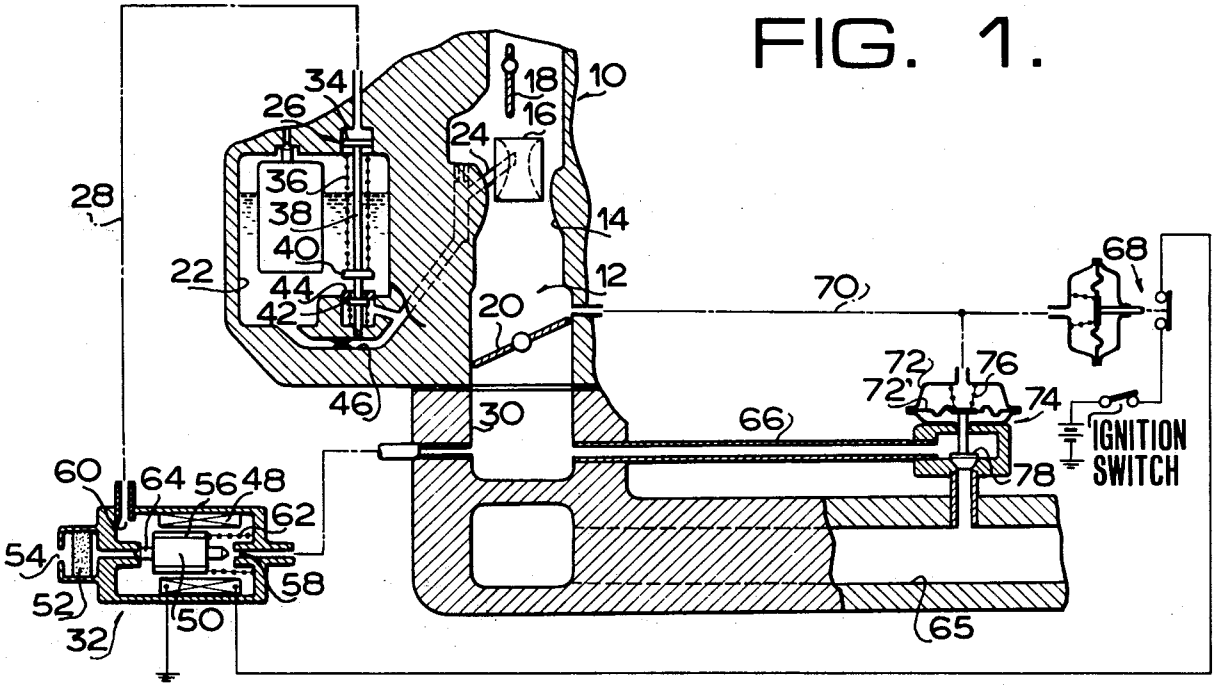
Figure 2:
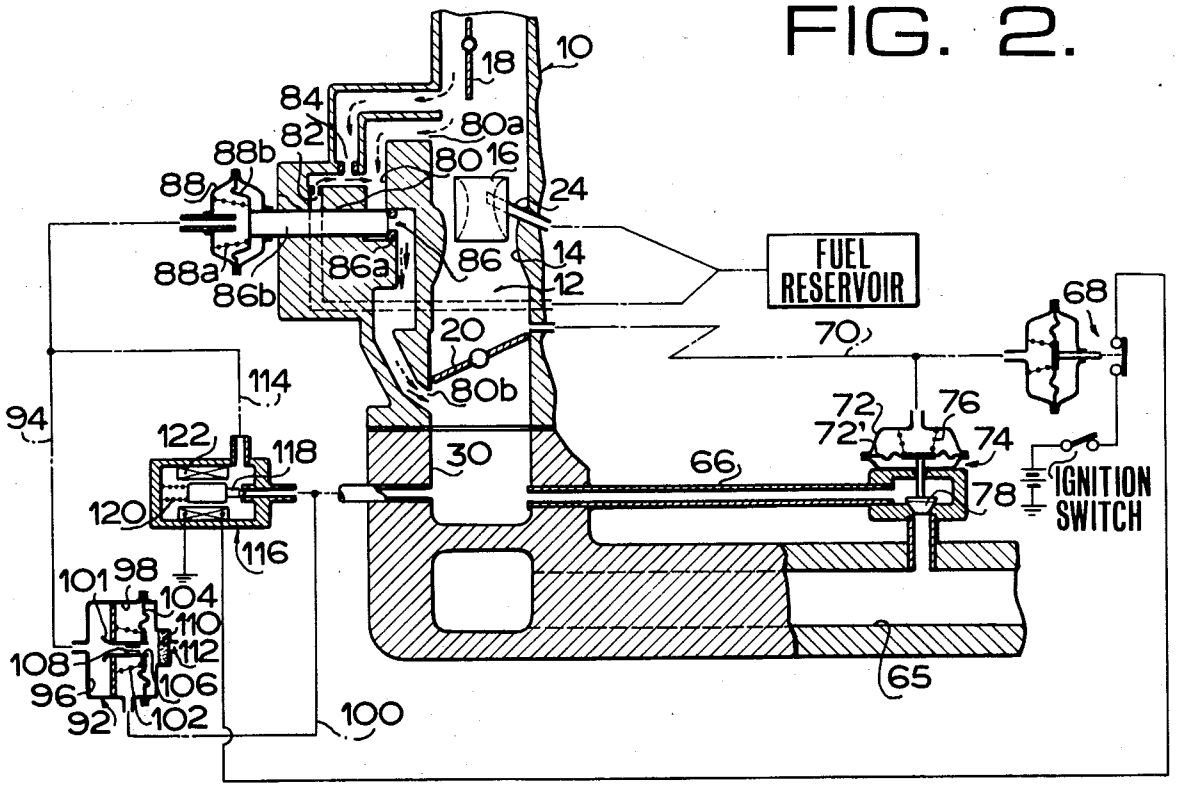

The other objects, features and advantages of the present invention will become apparent from the following description in connection with the accompanying drawings, in which:

FIG. 1 is a schematic view of a portion of an internal combustion engine according to the present invention; and FIG. 2 is a similar view to FIG. 1 showing a second embodiment of an internal combustion engine according to the present invention.

Referring to FIG. 1 a carburetor is shown generally at reference numeral 10 and formed with an air induction passage 12. A conventional main venturi 14 is disposed in the induction passage 12 and includes a booster or fuel supply venturi 16 disposed therein. A choke valve 18 is disposed in the induction passage 12 and is adapted to control the air-fuel ratio to provide an enrichment thereof during engine starting conditions. A throttle valve 20 is rotatably disposed in the induction passage 12 to control the quantity of air-fuel mixture flow through the induction passage 12.

A fuel reservoir 22 is formed in a casing of the carburetor 10 and is adapted to supply fuel to a main nozzle 24 which connects with the booster venturi 16. In order to provide an enrichment of the air fuel ratio during high power demanded conditions, a conventional power piston device 26 is provided. A conduit 28 is connected to the power piston device 26 and communicates with an intake manifold 30 when a control device 32 is in the illustrated position. Assume now that the control device 32 is in the illustrated position and manifold vacuum at all time exists in the conduit 28. During light load operating conditions, manifold vacuum in the conduit 28 is of sufficiently high value to retain a power piston 34 in its upper position as shown in the drawing, and to thereby compress a spring 36. A rod 38 secured to the power piston 34 includes an enlarged end 40 which abuts a valve member 42 which blocks fuel flow through an orifice 44 when the piston 34 is in its upper position. Under these circumstances fuel will be drawn from the fuel reservoir 22 to a continuously open orifice passage or jet 46 which supplies the fuel nozzle 24. In the event of a high demand situation, increased engine load will cause manifold vacuum in the conduit 28 to drop permitting the spring 36 to move the rod 38 downwardly opening the valve 42 supplying additional fuel to the passage 46. The operation of the power piston will be considered further in regard to the control device 32.

The control device 32 functions to connect the conduit 28 to the intake manifold 30 to apply the manifold vacuum to the power piston 34 when a solenoid 48 is de-energized and to vent or connect the conduit 28 to atmospheric pressure air when the solenoid 48 is energized to cause the vacuum in the conduit 28 to drop to the atmospheric pressure permitting the spring 36 to move the rod 38 downwardly, opening the valve 42 and supplying additional fuel to the passage 46. The control device 32 includes a slidable valve member 50 movable between a first position, as shown, to connect the conduit 28 to the intake manifold 30 and a second or vent position to vent or connect the conduit 28 to ambient atmosphere through a filter 52 and a vent aperture 54. The valve member 50 is formed with passage 56 to provide communication between ports 58 and 60 when it is in the illustrated position. A spring 62 biases the valve member 50 toward the illustrated position when the solenoid 48 is de-energized. The solenoid 48 when energized can move the valve member 50 to the vent position against the spring 62 opening a port 64 and closing the port 58.

In order to increase fuel supply in accordance with increase of exhaust gases recirculated from an exhaust pipe 65 into the intake manifold 30 through an exhaust gas recirculation conduit 66 thereby to maintain fuel-air ratio at a desired value, the solenoid 48 is circuited in series with a normally open pressure responsive switch 68 which is closed when the vacuum in a vacuum conduit 70 is higher than a predetermined value. The vacuum conduit 70 communicates a servo 72 of an EGR control valve device 74 with the intake passage 12 at a location positioned on the atmospheric side of, and adjacent to the throttle valve 20 when the throttle valve is closed in idle position. The EGR control valve 74 also includes a spring member 76 normally biasing a valve member 78 to block the flow of exhaust gases through the recirculation conduit 66. Force applied to the servo 72 by vacuum acting on a diaphragm 72' biases the valve member 78 against the spring force to permit the flow of exhaust gases through the recirculation conduit 66. The vacuum servo force overcomes the spring force to open the valve device 74 when the vacuum in the conduit 70 is higher than the predetermined value.

Now it will be understood from the preceding description that when the vacuum in the vacuum conduit 70 exceeds the predetermined value, the pressure responsive switch 68 is closed to energize the solenoid 48 moving the valve member 50 rightwardly against the spring 62 to connect the conduit 28 to the ambient atmosphere, and the servo 72 moves the valve member 78 upwardly against the spring 76 permitting exhaust gases to pass through the recirculation conduit 66 into the intake manifold 30. Under these circumstances the spring 36 of the power piston device 26 is permitted to move the rod 38 downwardly opening the valve 42 supplying additional fuel to the passage 46 and in turn to the fuel supply venturi 16. It will therefore be appreciated that increase of air fuel ratio due to recirculation of exhaust gases to the intake manifold 30 is prevented by the additional fuel supply by the power piston device 26.

In the first embodiment the power piston device 26 of the carburetor 10 is actuated when the vacuum in the vacuum conduit 70 is higher than the predetermined value in order to increase fuel supply when the exhaust gases are recirculated into the intake manifold 30 thereby to maintain air to fuel ratio constant. In the second embodiment shown in FIG. 2 instead of the power piston device 26 of the carburetor 10, an air fuel mixture circuit system which is operable to supply air fuel mixture into an induction passage downstream of the throttle valve of a carburetor during deceleration is modified in such a manner as to be made operable to supply additional air fuel mixture downstream of the throttle valve 20 when exhaust gases are recirculated into an induction passage downstream of the throttle valve or an intake manifold.

Referring to FIG. 2 the same reference numerals used in FIG. 1 to designate parts are used to designate corresponding parts. In order to supply air fuel mixture into an induction passage 12 downstream of a throttle valve 20 during deceleration of the vehicle, that is to say during period in which the throttle valve 20 is closed in idle position and in which the engine is driven by the vehicle at a relatively high speed, a by-pass air passage 80, a by-pass fuel jet 82, a by-pass air bleed 84, a by-pass valve 86, a servo 88 for opening the by-pass valve 86 and a control valve device 92 that permits manifold vacuum in an intake manifold 30 to act on the servo 88 when the intake manifold vacuum is higher than a predetermined value opening the by-pass valve 86 permitting air flow through the by-pass air passage 80 drawing fuel through the by-pass fuel jet 82 are provided in a conventional manner.

The by-pass passage 80 has an inlet port 80*a* communicating with the induction passage 12 upstream of a venturi 16 and an outlet port 80*b* communicating with the induction passage 12 downstream of the throttle valve 20. The by-pass passage 80 is provided with an air jet 86*a* which is normally closed by a plunger type valve member 86*b* of the by-pass valve 86. A by-pass fuel passage including the fuel jet 82 opens to the by-pass passage 80 upstream of the air jet 86*a*. The by-pass air bleed 84 opens to the by-pass fuel passage. A spring 88*a* normally biases the valve member 86*b* to block air flow through the by-pass air passage 80. Force applied to the servo 88 by vacuum acting on a diaphragm 88*b* biases the valve member 86*b* against the spring force to open the valve 86 to permit the flow of air through the by-pass air passage 80. The vacuum servo force overcomes the spring 88*a* to open the valve 86 when manifold vacuum in the intake manifold 30 is applied to the servo 88.

A vacuum conduit 94 is connected to the servo 88 and is normally connected to the atmosphere pressure air by the control valve device 92. The vacuum conduit 94 is permitted to communicate with manifold vacuum by the control valve device 92 when the manifold vacuum in the intake manifold 30 is higher than the predetermined reference manifold vacuum, that is to say during decelerations of the vehicle, moving the valve member 86*b* leftwardly to open the by-pass valve 86 supplying air fuel mixture into the induction passage downstream of the throttle valve 20 via port 80*b*.

The control device 92 comprises a chamber 96 to which the vacuum conduit 94 is connected and a chamber 98 connected to the intake manifold 30 through a conduit 100. Communication between the chambers 96 and 98 are opened or closed by a valve member 101. A spring 102 normally biases the valve member 101 to block or close communication between chambers 96 and 98. Force applied to a diaphragm 104 by manifold vacuum acting on the diaphragm biases the valve member 101 against the spring force to open communication between the chambers 96 and 98, permitting manifold vacuum applied to the vacuum conduit 94. The vacuum force overcomes the spring 102 when manifold vacuum in the intake manifold 30 exceeds the predetermined reference manifold vacuum. The valve member 101 has a vent passage 106 therethrough which vents the chamber 96 and in turn vacuum conduit 94 when the valve member 101 is in the illustrated closed position and which bleeds the conduit 94 when the valve member 101 is in opened position. The vent passage 106 is provided with an orifice 108 and open at one end to atmosphere through a filter 110 and a vent aperture 112.

To apply manifold vacuum to the servo 88 thereby to cause air fuel mixture to be supplied into the induction passage 12 downstream of the throttle valve 20 via the port 80*b* when the exhaust gas recirculation is effected, there is disposed in a conduit 114 a valve 116 which permits the conduit 94 to communicate with the intake manifold 30 when a pressure responsive switch 68 is closed. The conduit 114 connects the conduit 94 with the intake manifold 30 through a passage formed in the valve 116. The valve 116 comprises a valve member 118 movable between a first position (the illustrated position) to close the conduit 114 and a second position to open the conduit 114 to connect the conduit 94 with the intake manifold 30. A spring 120 normally biases the valve member 118 to the illustrated position when a solenoid 122 is de-energized. The solenoid 122 is circuited in series with the pressure responsive switch 68 to be energized upon closure of the switch 68. The solenoid 122 when energized can move the valve member 118 against the spring 120 to open the conduit 114 applying manifold vacuum to the servo 88.

It will be understood from the description of the second embodiment that when the exhaust recirculation is effected additional air fuel mixture is supplied via the port 80*b* to enrich air fuel mixture supplied from the venturi 16. It will thus be appreciated that air to fuel ratio is prevented from increasing when the exhaust gases are recirculated into the intake manifold 30 according to the present invention.

What is claimed is:

1. An internal combustion engine, comprising, an induction passage, a venturi formed in said induction passage, a throttle valve rotatably disposed in said induction passage for controlling the quantity of air-fuel mixture flow therethrough, a fuel reservoir, means for supplying fuel to said induction passage in accordance with the quantity of air flow through said induction passage, means for supplying additional fuel to said induction passage, said means for supplying additional fuel comprising an additional fuel valve means for controlling the additional fuel and a vacuum means for operating said additional fuel valve means, an exhaust passage communicating with said induction passage, passage means for recirculating a part of exhaust gases from said exhaust passage into said induction passage at the downstream of said throttle valve, a first valve means for controlling recirculation of exhaust gases through said recirculating passage means, a vacuum conduit communicating said first valve means with an atmospheric side of said throttle valve in said induction passage, said first valve means including a servo means operatively connected to said induction passage at a location positioned on the atmospheric side of and adjacent to said throttle valve when said throttle valve is closed in idle position through said vacuum conduit, a spring normally biasing said first valve means for blocking flow of exhaust gases through said recirculating passage means, said first valve means for being acted on by vacuum in said induction passage against said spring to permit the flow of exhaust gases through said recirculating passage means, a first conduit for operatively connecting said vacuum means with said induction passage downstream of said throttle valve, means for controlling the vacuum applied to said vacuum means through said first conduit, said means for controlling the vacuum including a solenoid valve means adapted for actuation simultaneously with actuation of said first valve means for controlling the vacuum applied to said vacuum means for the supply of the additional fuel.

2. An internal combustion engine as claimed in claim 1, in which said servo means for vacuum force biasing said first valve means against said spring for overcoming the force of said spring when vacuum in said vacuum conduit is higher than a predetermined value.

3. An internal combustion engine as claimed in claim 1, in which said means for supplying additional fuel includes a power piston means, constituting said vacuum means, for increasing the quantity of fuel flow during high power demanded operating conditions and said first conduit operatively connecting said power piston means with said induction passage downstream of said throttle valve to maintain said power piston means in an inoperative condition during normal engine operation.

4. An internal combustion engine as claimed in claim 1, wherein said means for controlling the vacuum and said solenoid valve means are constructed as one unit, the latter includes a second valve means fluidly disposed in said first conduit, and said second valve means is movable between a first position to vent said first conduit and a second position to permit said first conduit to communicate with said induction passage, and said solenoid valve means is for moving said second valve means to the first position when said first valve means is actuated.

5. An internal combustion engine as claimed in claim 1, wherein said means for supplying additional fuel includes means for supplying fuel with induced air to said induction passage downstream of said throttle valve during deceleration operating conditions, conduit means connecting said fuel with induced air-supplying means with said induction passage downstream of said throttle valve, and said additional fuel valve means is disposed in said conduit means for controlling the supply of the additional fuel with induced air.

6. An internal combustion engine as claimed in claim 1, wherein said means for controlling the vacuum includes a vacuum valve means, the latter and said solenoid valve means are connected in parallel in said first conduit, and said solenoid valve means is moveable between a first position to close passage therethrough and a second position to open passage therethrough, respectively.

* * * * *